United States Patent [19]

Horigome et al.

[11] 4,013,917

[45] Mar. 22, 1977

[54] COUPLED CAVITY TYPE SLOW-WAVE STRUCTURE FOR USE IN TRAVELLING-WAVE TUBE

[75] Inventors: Toshinori Horigome; Sadanori Hamada; Takami Sato, all of Tokyo, Japan

[73] Assignee: Nippon Electric Company, Ltd., Tokyo, Japan

[22] Filed: Nov. 26, 1975

[21] Appl. No.: 635,734

[30] Foreign Application Priority Data

Dec. 3, 1974 Japan ..... 49-139088

[52] U.S. Cl. ..... 315/3.5; 315/39.3; 333/31 A

[51] Int. Cl.[2] ..... H01J 25/34

[58] Field of Search ..... 315/3.5, 39.3, 3.6; 333/31 A

[56] References Cited

UNITED STATES PATENTS

| | | | |
|---|---|---|---|
| 2,970,242 | 1/1961 | Jepsen | 333/31 A |
| 3,153,767 | 10/1964 | Kyhl | 315/3.5 |
| 3,181,024 | 4/1965 | Sensiper | 315/3.5 |
| 3,471,738 | 10/1969 | Bert | 315/3.5 |
| 3,602,766 | 8/1971 | Grant | 315/3.5 |
| 3,889,148 | 6/1975 | Gross | 315/3.5 |
| 3,909,651 | 9/1975 | Baker et al. | 315/3.5 |
| 3,924,151 | 12/1975 | Gross | 315/3.5 |

*Primary Examiner*—Saxfield Chatmon, Jr.
*Attorney, Agent, or Firm*—Ostrolenk, Faber, Gerb & Soffen

[57] ABSTRACT

A coupled cavity type slow-wave structure for use in a travelling-wave tube, in which there are provided at a given spacing a plurality of partition walls within a circular wave-guide, with dielectric cylindrical pieces or spacers being confined between each pair of the aforesaid partition walls and in concentric relation to central apertures defined in the aforesaid partition walls. The dielectric cylindrical pieces are provided with holes slightly larger than the aforesaid central apertures in the partition walls, and the aforesaid central apertures are adapted to pass electron beams therethrough. In addition, the partition walls each have coupling slots, through which adjoining cavities are in communication with each other. The dielectric cylindrical pieces are brazed to the adjacent partition walls in gas-tight relation. This insures an accurate spacing between each pair of partition walls and eliminates thermal deformation in those portions of the partition walls which surround the aforesaid central apertures, particularly the portions encircled interiorly of the dielectric cylindrical pieces.

4 Claims, 5 Drawing Figures

COUPLED CAVITY TYPE SLOW-WAVE STRUCTURE FOR USE IN TRAVELLING-WAVE TUBE

BACKGROUND OF THE INVENTION

1. Field of the Invention

This invention relates to a travelling-wave tube, and more particularly a coupled cavity type slow-wave structure for use in a high power travelling wave tube.

2. Description of the Prior Art

In slow-wave structures of the type used in a travelling-wave tube, the propagating speed of an input signal wave is slowed down to make it comparable to that of electron beams passing through the slow-wave structure, thereby bringing about the interaction between an input signal wave and an electron beam. In this connection, there arises a problem that dimensional uniformity or accuracy of the slow-wave structure has a significant effect upon its output characteristics.

This is particularly true with a coupled cavity type slow-wave structure for use in a high power travelling-wave tube, and thus difficulties are encountered in the manufacture of the slow-wave structure which may satisfy the aforesaid requirements. As has been described, the partition walls are respectively provided with central apertures adapted to pass electron beams therethrough and with coupling slots which are located in the neighborhood of the central apertures and are adapted to effect electromagnetic coupling of the adjoining cavities, while the partition walls are periodically arranged at a given spacing within a circular waveguide. Upon brazing, however, thermal deformation tends to take place in the partition walls due to the heat cycle of the brazing operation. Particularly, nonsymmetric configurations of the partition walls due to the presence of coupling slots are unfavorable for avoiding deformation of the partition walls. On the other hand, accurate axial alignment of the central apertures in the partition walls is required to assure passage of the electron beams therethrough. However, the use of a jig or tool for assuring and/or correcting the axial alignment of central apertures leads to deformation of partition walls, because the partition walls are formed of a material which softens due to the heat arising from brazing.

In addition, there is another problem in that the temperature at the partition walls is increased due to the ohmic loss of high frequency current passing through the partition walls constituting the major portion of the slow wave structure, even when the tube is brought into operation. This temperature rise in the partition walls causes deformations in the partition walls, presenting inaccurate dimensions therefor. The failure to achieve and maintain accurate dimensions in turn leads to the failure in the impedance matching of the slow-wave structure with an external waveguide to supply through an input signal wave or extract an output signal wave, as well as impedance matching within the slow-wave structure itself, resulting in inaccurate responsiveness or relationship of an output signal to an input signal, and thereby presenting unfavorable results.

Still additionally, the prior art slow-wave structure poses a shortcoming of allowing no possibility of repair in the event of defective characteristics, because the slow wave structure in its entirety constitutes a vacuum envelope.

A yet another problem encountered with the prior art travelling-wave tube is that the outer dimensions of a coupled cavity type slow-wave structure are larger than the outer diameter of a helix type slow-wave structure, requiring the use of an electromagnet for obtaining a magnetic flux density of a magnitude required for focussing electron beams. This unavoidably leads to an extremely large increase in the outer diameter of the travelling-wave tube, as disclosed in a paper entitled "The Ground Station High-Power Travelling-Wave Tube" by R. J. Collier, et al., published in THE BELL SYSTEM TECHNICAL JOURNAL, July issue, 1963, pages 1829 to 1861.

SUMMARY OF THE INVENTION

Accordingly, it is an object of the present invention to provide a slow-wave structure for use in a travelling-wave tube, which structure avoids shortcomings experienced with the prior art slow-wave structure by maintaining dimensional accuracy and desired characteristics.

It is another object of the present invention to provide a slow wave structure of the type described, which consists of the electron-beam-passing portion forming the vacuum envelope and a surrounding peripheral portion, which design facilitates ready replacement or repair of the travelling-wave tube.

It is a further object of the present invention to provide a slow-wave structure of the type described, which is relatively small in its outer diameter, and allows the use of permanent magnets arranged at a given spacing.

According to the present invention, there is provided a coupled cavity type slow-wave structure for use in a travelling-wave tube, in which there are provided partition walls periodically arranged at a given spacing and having electron-beam-passing central apertures, and coupling slots communicating adjoining cavities with each other, the aforesaid structure featuring hollow cylindrical dielectric pieces or spacers having inner diameters larger than the diameters of central apertures and respectively confined between the adjoining partition walls in concentric relation to the central apertures.

DESCRIPTION OF THE PREFERRED EMBODIMENT

Figure 1:
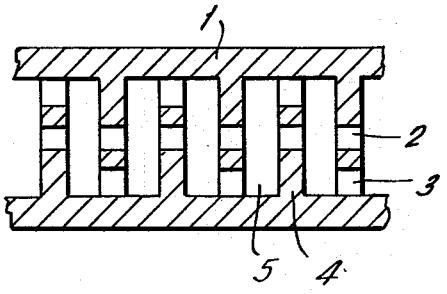
FIG. 1. (PRIOR ART)
FIGS. 1 and 1*a* respectively show a longitudinal cross-sectional view and a transverse cross-sectional view of the essential part of the prior art slow-wave structure for use in a travelling-wave tube.
Figure 1A:
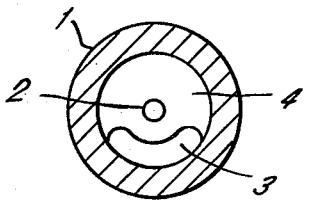
FIG. 1a. (PRIOR ART)

Referring now to FIG. 1, there is shown a prior art slow-wave structure, in which partition walls 4 are arranged at a given spacing within a circular waveguide 1, and each wall is provided with central apertures 2 which allow the passing of electron beams therethrough, and coupling slots 3 for coupling electromagnetic fields, thereby providing a cavity 5 defined by each adjacent pair of partition walls with central apertures and coupling slots, and the circumferential inner wall of the waveguide. Those portions of the partition walls, which surround the central apertures, are supported only by the portions of the partition walls extending from the inner wall surface of the waveguide towards the center line thereof.

In other words, the partition walls are not supported by spacer means to be described hereinafter in connection with the slow-wave structure according to the present invention. As a result, deformation of partition walls directly leads to axial misalignment of the central apertures. The deformation of partition walls is caused by the heating cycle employed when brazing partition walls to a waveguide. In this respect, because of the non-symmetric configuration of the partition walls due to the presence of coupling slots, the partition walls are quite susceptible to deformation, as compared with an ordinary circular plate or disc having no apertures. In addition, for achieving desired passing of electron beams, the accurate axial alignment of the central aperture becomes necessary. However, after brazing, the material of partition walls will be softened, so that insertion of a jig or tool into the central apertures leads to further increased misalignment of the central apertures.

Figure 2:
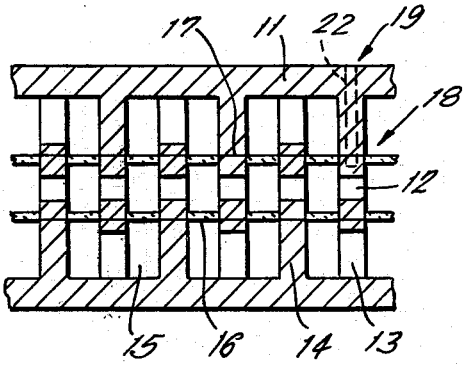
FIGS. 2 and 2*a* respectively show a longitudinal cross-sectional view and a transverse cross-sectional view of the essential part of the embodiment of the present invention.
Figure 2A:
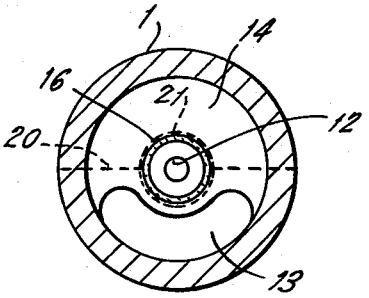

Turning now to FIGS. 2 and 2*a*, a slow-wave structure according to the present invention is shown, as comprising partition walls 14 arranged at a given spacing within a circular waveguide 11. The partition walls 14 are provided with central apertures 12 for passing the electron beam and with coupling slots 13 adapted to effect electromagnetic wave coupling for the adjoining cavities, presenting a cavity 15. Confined between each pair of adjoining partition walls 14 but in concentric relation with the electron-beam-passing central apertures 12 are hollow cylindrical dielectric pieces or spacers 16 having inner diameters at least slightly larger than the diameters of the central apertures 12. The dielectric cylindrical pieces are hermetically brazed to the adjacent partition walls, respectively.

According to the slow-wave structure of the present invention, the variation in spacing of partition walls, particularly in the neighborhood of the central apertures, may be minimized within an allowable range, while maintaining the desired accuracy of spacing between the central apertures adapted to pass electron beams therethrough. In this respect, the dielectric cylindrical pieces or spacers govern the spacing between the adjoining central apertures, being positioned in the immediate vicinity of the central apertures, so that the likelihood of deformation of those portions of partition walls which are encircled with the dielectric cylindrical pieces is significantly reduced. In this case, those portions of the partition walls which are encircled with the dielectric cylindrical pieces are symmetrical, so that thermal deformation therein may be minimized to a satisfactory tolerance range and, in addition, a jig or tool may be safely inserted into the central apertures adapted to pass electron beams therethrough.

According to another aspect of the present invention the vacuum condition is maintained within the electron-beam-passing portion 18 which consists of an imaginary axially elongated cylindrical body including the dielectric cylindrical pieces or spacers 16 as well as those portions of the partition walls which are encircled by the spacers 16. As a result, the peripheral portion 19 of the slow-wave structure, which surrounds the aforesaid electron-beam-passing portion 18 may be formed separately and independently of the aforesaid elongated cylindrical body of the electron-beam-passing portion 18.

According to a further aspect of the present invention, those portions of partition walls which are encircled with the spacers 16 may be separated from the other portions of partition walls 14, and the electron-beam-passing portion consists of spacers 16 and those aforesaid portions may be inserted as a unit or one piece assembly into holes (see dotted circle 21) in the partition walls and secured in position by means of substantially radially aligned screws extending from the peripheral surface of the body 19 of the structure through the partition walls into the aforesaid portions of the partition walls which are encircled with the spacers 16.

Figure 3:
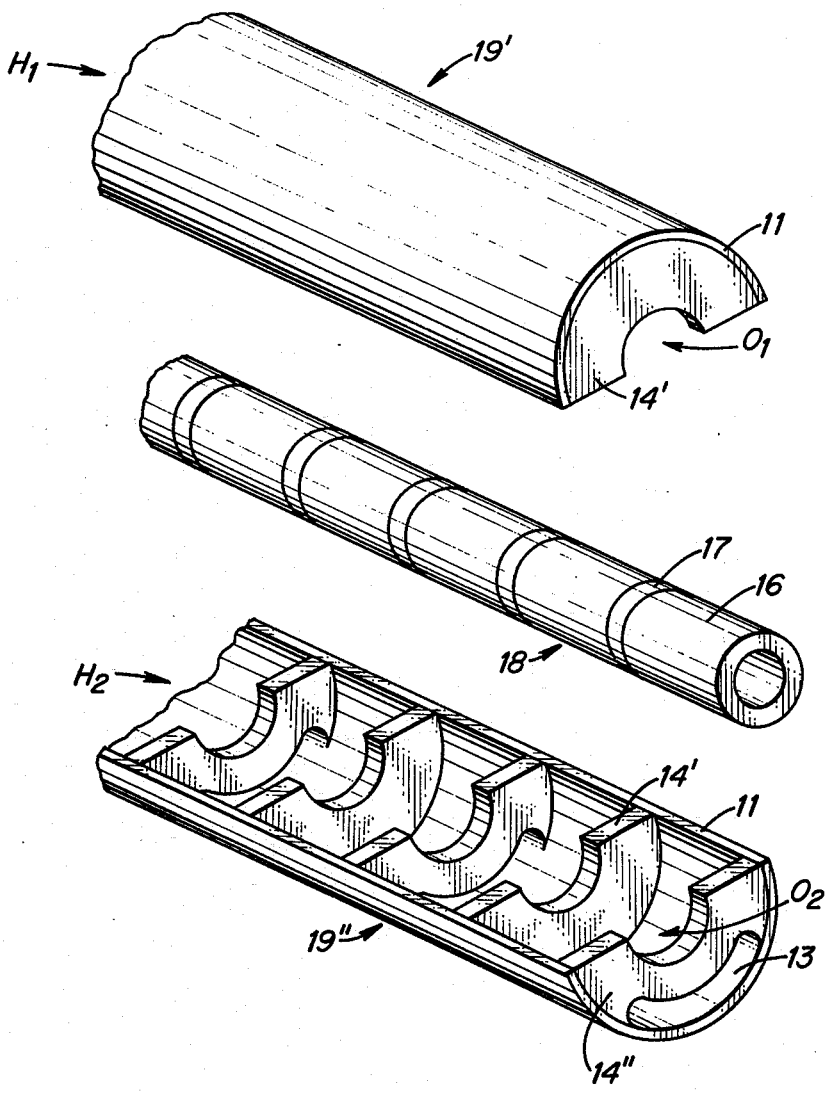
FIG. 3 is an exploded perspective view of the embodiment of FIG. 2 which is capable of being readily assembled and disassembled.

According to a yet further aspect of the present invention (see FIG. 3), the peripheral portion 19 of the structure, excluding the aforesaid elongated cylindrical, electron-beam-passing portion 18, may be split into two halves $H_1$ and $H_2$ along the longitudinal axis of the structure, presenting half circular walls 14' and 14'' in its halves $H_1$ and $H_2$ as shown by the dotted lines 20 and 27 in FIG. 2 and as shown in FIG. 3. As a result, the aforesaid two halves may be disassembled, as required, and may be re-assembled by means of fastening means such as screws. FIG. 2 shows one possible location for a fastening means 22. The semi-circular openings $O_1$ and $O_2$ cooperate to form a circular opening which surrounds an associated one of the spacers 17.

Accordingly, in the event of the defective characteristics of the slow-wave structure, the peripheral portions 19 located outside of the electron-beam-passing portion 18 or dielectric cylindrical pieces 16 may be removed from the travelling-wave tube for its replacement for a new peripheral portion 19. This eliminates complicated operations for the travelling-wave tube, such as re-evacuation or aging, which would otherwise have been required (in the repair or rebuilding of a tube) according to the prior art travelling-wave tube.

According to a yet further aspect of the present invention, the outer diameter of the slow-wave structure may be reduced relative to a predetermined amplifying frequency, and permanent magnets may be used to provide periodic magnetic fields. The effective dimensions of the dielectric cylindrical pieces 16 reduced in free space are proportional to the square root of the specific inductive capacity $\epsilon s$ of the dielectric cylindrical pieces 16 which are placed in the respective cavities. Thus, the effective cavity dimensions may be increased by ( $\sqrt{\epsilon s}-1$) × (the ratio of the spaces occupied by the dielectric cylindrical pieces within the respective cavities to the spaces of the cavities). In the present invention, high-purity beryllia ceramics or alumina ceramics may be used. These materials present specific inductive capacities $\epsilon s$ of 6.6 or 9.2 respectively, leading to a reduction of 20 to 30% in the outer diameter of the slow-wave structure for use at a frequency of 14 GHz band. The reduction in the outer diameter enables the use of permanent magnets which present desired magnetic flux densities for focussing electron beams and reduces the outer diameter of the entire apparatus, including the coupled cavity type travelling-wave tube, and permanent magnet to about 1/10 in comparison with tubes using an electromagnet.

As is apparent from the foregoing description of the coupled cavity type slow-wave structure according to the present invention, the dielectric cylindrical pieces or spacers disposed between each pair of partition walls in encircling relation to the central apertures provided in the partition walls serve to prevent deformation of partition walls, while maintaining accurate spacing between each adjoining partition walls, so that accurate spacing, as well as prevention of deformation, of partition walls may be maintained not only during the operation but also in the manufacture.

In addition, vacuum is maintained within an electron-beam-passing portion including the dielectric cylindrical pieces, so that the slow-wave structure may be repaired with ease.

Furthermore, dielectric cylindrical pieces having a high specific inductive capacity are placed within the cavities, so that the effective cavity-dimensions may be increased and thus, in terms of a predetermined amplifying frequency, the outer dimensions of the coupled cavity type slow wave structure may be rendered smaller, while enabling the focussing of electron beams by means of periodic permanent magnets.

Although the present invention has been described with respect to the specific details of certain embodiments thereof, it is not intended that such details be limitations upon the scope of the invention except insofar as set forth in the following claims.

What is claimed is:

1. A coupled cavity type slow-wave structure for use in a travelling-wave tube, wherein a plurality of partition walls are arranged at a given spacing within a circular waveguide to define a plurality of cavities, each partition wall serving as the common wall between adjoining cavities and provided with central apertures which are axially aligned to permit passage of electron beams therethrough, and coupling slots communicating the adjoining cavities with each other; characterized by being further comprised of dielectric cylindrical spacers each having an inner diameter larger than the diameter of said central apertures and axially aligned with said central apertures between each pair of said partition walls, said dielectric cylindrical spacers being brazed to said partition walls;

said electron-beam passing portion, including said dielectric cylindrical pieces which are placed in encircling relation to said central apertures, being hermetically sealed and is adapted to be removably mounted as a unit within the peripheral portion of said structure.

2. A coupled cavity type slow-wave structure as set forth in claim 1, wherein said peripheral portion of said structure is secured to said sealed electron-beam-passing portion by means of fastening means including screws.

3. A coupled cavity type slow-wave structure as set forth in claim 1, wherein said peripheral portion of said structure is split along its longitudinal axis.

4. A coupled cavity type slow-wave structure for use in a travelling-wave tube having a circular waveguide comprising a first electron-beam-passing assembly and a second peripheral assembly which is secured to said electron-beam-passing assembly in surrounding and contacting relation thereto;

said first assembly comprising a plurality of inner partition wall portions arranged at spaced intervals within said circular waveguide, and provided with central apertures which are axially aligned to permit passage of electron beams therethrough, a plurality of dielectric cylindrical spacers each having an inner diameter larger than the diameter of said central apertures and being axially aligned with said central apertures between each adjacent pair of said inner partition wall portions, said dielectric cylindrical spacers being brazed to said inner partition wall portions;

said second assembly comprising outer partition wall portions spaced to be aligned with an associated inner partition wall portion and having a central opening surrounding its associate inner partition wall portion so that each inner and outer partition wall portion cooperatively defines a partition wall;

said outer wall portions having coupling slots;

each adjacent pair of partition walls defining a cavity wherein said slots provide communication between adjacent cavities;

said second assembly being removably joined to said first assembly to facilitate repair and maintenance of the tube.

* * * * *